US012071745B1

(12) United States Patent
Zimmerman

(10) Patent No.: US 12,071,745 B1
(45) Date of Patent: Aug. 27, 2024

(54) LOAD DEPENDENT RANGE SHIFT CONTROL

(71) Applicant: CNH Industrial America LLC, New Holland, PA (US)

(72) Inventor: Joshua D. Zimmerman, Plainfield, IL (US)

( * ) Notice: Subject to any disclaimer, the term of this patent is extended or adjusted under 35 U.S.C. 154(b) by 0 days.

(21) Appl. No.: 18/127,154

(22) Filed: Mar. 28, 2023

(51) Int. Cl.
*E02F 9/22* (2006.01)

(52) U.S. Cl.
CPC ..... *E02F 9/2253* (2013.01); *E02F 9/2235* (2013.01); *E02F 9/226* (2013.01); *E02F 9/2289* (2013.01); *E02F 9/2292* (2013.01)

(58) Field of Classification Search
CPC ..... E02F 9/2253; E02F 9/2235; E02F 9/226; E02F 9/2289; E02F 9/2292
USPC ..... 701/51
See application file for complete search history.

(56) References Cited

U.S. PATENT DOCUMENTS 5,676,017 A * 10/1997 Allen, Jr. ..... B60W 10/111 74/336 R
8,758,199 B2 6/2014 Nishi et al.
8,918,258 B2 12/2014 Hoff et al.
9,347,554 B2 5/2016 Metzger et al.
11,054,026 B2 7/2021 Afshari
2001/0007212 A1* 7/2001 Nemoto ..... F16H 61/462 74/731.1
2012/0065853 A1 3/2012 Stoller et al.
2021/0131060 A1* 5/2021 Zell ..... E02F 9/2228
2021/0131070 A1* 5/2021 Oasa ..... F16H 61/475
2021/0222402 A1 7/2021 Zimmerman

FOREIGN PATENT DOCUMENTS

CN 102155033 A 8/2011
CN 112664650 A 4/2021
DE 202020107048 U1 4/2021
WO 2021096262 A1 5/2021

* cited by examiner

*Primary Examiner* — Colby M Hansen
(74) *Attorney, Agent, or Firm* — Rickard K. DeMille; Rebecca L. Henkel; Peter K. Zacharias

(57) ABSTRACT

A work vehicle includes a hydraulic shift control system that enables the work vehicle to smoothly change speeds during a shift and reduce abrupt changes. The hydraulic shift control system may predict undesirable scenarios associated with the abrupt changes. The hydraulic shift control system may utilize configuration data, feedback data (e.g., sensor data), and modeling data to estimate certain operation states and/or parameters, such as engine loads and hydraulic pressures. In response to determining that predicted values may exceed certain thresholds (e.g., maximum load or pressure), the hydraulic shift control system may perform proactive actions to prevent shifting that may cause undesirable outcomes for the work vehicle.

13 Claims, 5 Drawing Sheets

LOAD DEPENDENT RANGE SHIFT CONTROL

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Hydraulic systems may be used on various pieces of equipment, such as on work vehicles (e.g., for agriculture, construction, shipping). These hydraulic systems use a pressurized hydraulic fluid provided by a hydraulic pump to perform various tasks. In operation, the hydraulic pump pressurizes hydraulic fluid received from a hydraulic fluid source. Some work vehicles use this pressurized hydraulic fluid to drive hydraulic motors that generate rotational power. The rotational power may then be used to drive wheels on a work vehicle. For example, the wheels may rotate tracks that are coupled to the wheels, such as on a skid steer.

A work vehicle (e.g., skid steer loader, dozer, dozer loader) with a hydraulic system may operate in certain discrete settings associated with different gears, speeds, pump displacements, motor displacements, or other relevant settings. When the hydraulic system shifts from one setting to a different setting, the shift may cause certain undesirable outcomes for the work vehicle. For example, when the hydraulic system shifts from a low speed to a higher speed, the shift may cause the work vehicle to lurch in response to a rapid change (e.g., a change in hydraulic motor volume with no change in hydraulic fluid flow delivered by the hydraulic pump).

BRIEF DESCRIPTION

This summary is provided to introduce a selection of concepts that are further described below in the detailed description. This summary is not intended to identify key or essential features of the claimed subject matter, nor is it intended to be used as an aid in limiting the scope of the claimed subject matter.

In certain embodiments, a work vehicle that includes a hydraulic system and a hydraulic shift control system. The hydraulic system includes a hydraulic motor to drive one or more wheels of the work vehicle and a hydraulic pump to pump hydraulic fluid to the hydraulic motor. The hydraulic shift control system includes a controller having a memory and a processor. The controller receives vehicle data associated with a shift command indicative of a shift operation, generates prediction data by estimating one or more vehicle operation parameters based on the vehicle data, determines whether the shift operation is implementable based on the prediction data, and controls the hydraulic system to perform the shift operation in response to determining that the shift operation is implementable.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
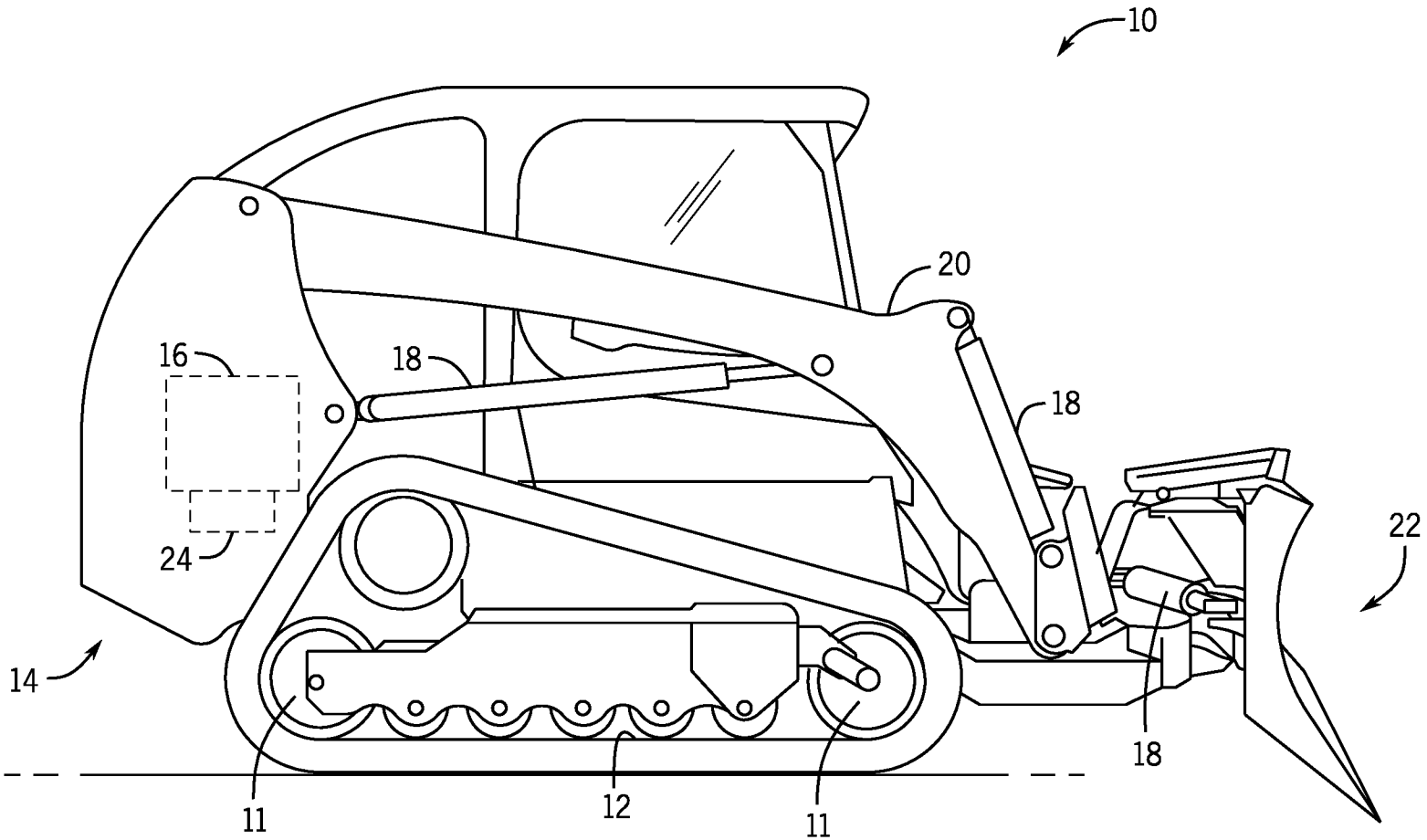
FIG. 1 is a side view of an embodiment of a work vehicle that includes a hydraulic system and a hydraulic shift control system, in accordance with the present disclosure.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

As used herein, the term "coupled" or "coupled to" may indicate establishing either a direct or indirect connection, and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

Work vehicles (e.g., vehicles used in agriculture, construction, shipping) may include one or more hydraulic systems that provide power to complete various tasks. These tasks may include loading, lifting, pushing, rotating, dozing, and moving the work vehicle. A work vehicle may include a hydraulic system that includes hydraulic pumps coupled to hydraulic motors. Each hydraulic pump may pump hydraulic fluid (e.g., oil) to a corresponding hydraulic motor. Each hydraulic motor may drive one or more wheels of the work vehicle. In certain work vehicles, the wheels in turn couple to tracks which enable the work vehicle to traverse various types of terrain.

Depending on the terrain and/or job, a user (e.g., an operator of the work vehicle) may desire to drive the work vehicle at different speeds. To change speeds at which the work vehicle travels, the user may shift up or shift down the hydraulic system. The hydraulic system may include a hydraulic shift control system that controls shifting of the hydraulic system. The hydraulic shift control system may include a controller that controls, for example, fluid volumes pumped by the hydraulic pumps and motor volumes of the hydraulic motors, thereby enabling the hydraulic system to change a vehicle speed via a shift.

For example, the hydraulic system (e.g., including a hydraulic ground drive system) of the work vehicle may include a number of discrete hydraulic gears (e.g., 16 gears), which may be operated by discretely shifting a continuous pump through a number of volume settings (e.g., 8 volume settings) in a low range (e.g., ranging from 0 to X, where X may be any percent between 0 and 100 percent) and a number of different volume settings (e.g., 8 different volume settings) in a high range (e.g., ranging from X to 100 percent). The low range may be obtained by having a dual displacement motor in a high volume state. The high range may be obtained by having the dual displacement motor in a low volume state.

In response to a shift command, the hydraulic shift control system may control the hydraulic gears to change operations of the hydraulic motors and/or pumps. For example, the hydraulic shift control system may control the hydraulic gears to increase or decrease the hydraulic motor volumes. When shifting through the hydraulic gears (e.g., in an upshift causing a hydraulic motor to shift from the low range to the high range), an engine driving the hydraulic pumps may have a resulting engine torque that may exceed a threshold (e.g., maximum torque) for an engine, thereby causing the engine to stall or reducing the vehicle speed. In some cases, a shift (e.g., an upshift) may result in an increased hydraulic pressure that may exceed a pressure relief limit, causing a ground drive (e.g., and the respective wheel(s)) to slow or stop due to losing hydraulic fluid flow over a pressure relief valve instead of delivering the hydraulic fluid to the hydraulic motor.

The present disclosure describes systems and methods for load dependent range shift control for a hydraulic system of a work vehicle. The load dependent range shift control system may use feedback data to estimate a load (e.g., engine torque load) and hydraulic pressure associated with a shift to be performed by the hydraulic system. The feedback data may be in the form of measured hydraulic pump pressures paired with hydraulic pump commands, or measured hydraulic pump volumes that may be used with known gear ratios and other known system loads to estimate the load on an engine. The feedback data may also include an estimation from the engine on a current load, or an estimation of the hydraulic pressure based on the known engine load using measured engine speed, commanded engine speed and a known torque/speed profile of the engine.

With an estimation of the engine load and hydraulic pressure under instantaneous operating conditions, an estimation of the expected engine load and hydraulic pressures in the next higher hydraulic gear may be made using the known pump and motor volumes in the current gear and the next higher gear. In certain embodiments, higher drag loads that occur with higher speeds may be estimated. The estimation may enable certain operations prior to a shift, such as determining whether there is sufficient torque reserve in the engine before allowing the work vehicle to shift to a higher gear. The torque reserve may be calculated with reference to peak engine torque or to some reference torque corresponding to an allowable droop in engine rpm from increased load torque. The estimation may also enable determining whether there is sufficient pressure reserve in the hydraulic system before allowing the hydraulic system to shift the gear that may result in a hydraulic torque limitation due to pressure being relieved through a hydraulic relief valve, for example. In this way, the hydraulic shift control system may prevent the work vehicle from shifting into a higher speed range that may stall the engine or the ground drive in certain cases such as shifting the motor volume from high volume to low volume that may result in insufficient torque in the motors to keep pushing the vehicle forward.

Additionally, or alternatively, the hydraulic shift control system may monitor the engine torque and/or the pressure reserves. If the hydraulic shift control system determines that one or more limits associated with the engine load and/or the hydraulic pressure may be reached (e.g., for the subsequent shift), a downshift may be implemented to shift the hydraulic motor from a high range back to a low range. In certain embodiments, small shifts (e.g., in virtual gears) may be enforced. In some cases where the hydraulic systems may have an anti-stall system such that pump commands may be reduced automatically to prevent the engine stall based on engine speed feedback, the gear setting may not change and the work vehicle speed may be reduced for a given gear setting temporarily until the engine load is reduced and the engine speed is recovered.

The load dependent range shift control system may automatically predict the load (e.g., an instantaneous engine torque load, a hydraulic pressure in a ground drive of the work vehicle) for the shift (e.g., a shift from a low range to a high range). In response to determining that the predicted load caused by the shift exceeds a threshold load acceptable by the hydraulic system, the load dependent range shift control system may perform one or more proactive actions to prevent the hydraulic system from performing the shift, thereby avoiding potentially undesirable outcomes for the work vehicle (e.g., reducing or eliminating lurching of the work vehicle during the shift).

Although the examples mentioned above regarding certain undesirable outcomes for the work vehicle are described with respect to the upshift, in other scenarios, such undesirable outcomes may occur at any operating condition, including during a downshift. The load dependent range shift control system disclosed herein may predict these scenarios and prevent shifting that would cause undesirable outcomes for the system.

With the forgoing in mind, FIG. 1 is a side view of an embodiment of a work vehicle 10 (e.g., a skid steer). The work vehicle 10 may include wheels 11 and tracks 12 that enable the work vehicle 10 to move. The work vehicle 10 includes an engine 14 that provides power to a hydraulic system 16. The hydraulic system 16, in turn, drives the wheels 11, which rotate the tracks 12. The hydraulic system 16 may also power other systems on the work vehicle 10. For example, the hydraulic system 16 may provide power to hydraulic actuators 18 (e.g., hydraulic cylinders) that control operation of one or more arms 20 (e.g., booms), one or more tools 22, other movable components of the work vehicle 10 or attached to the work vehicle 10, or a combination thereof. The one or more tools 22 may be attached to the arms 20 and enable the work vehicle 10 to perform various tasks, such as loading, dozing, lifting, pushing, rotating, and so on. The one or more tools 22 may include forks, buckets, plows, blades, and the like. Each of the one or more tools 22 may enable the work vehicle 10 to perform one or more tasks.

The hydraulic system 16 may include one or more hydraulic pumps and one or more hydraulic motors that provide power to the wheels 11 of the work vehicle 10. The hydraulic pumps may pump hydraulic fluid (e.g., oil) to the hydraulic motors. As a result, the hydraulic motors may drive the wheels to rotate. The wheels 11 may couple to the tracks 12 such that rotating the wheels 11 causes the tracks 12 to move forward or backward, thereby driving the work vehicle 10 to traverse various types of terrain. The work vehicle 10 may include a hydraulic shift control system 24. The hydraulic shift control system 24 may communicatively couple to the hydraulic system 16. The hydraulic shift control system 24 may control operations of one or more hydraulic pumps and one or more hydraulic motors of the work vehicle 10.

In certain cases, the hydraulic system 16 may receive an instruction to shift from one operation mode (e.g., a low speed mode) to another operation mode (e.g., a high speed mode). Such shift may cause the work vehicle 10 to operate undesirably (e.g., lurch) in response to a rapid change (e.g., a change in hydraulic motor volume with no change in hydraulic fluid flow delivered by a hydraulic pump).

To reduce or eliminate undesirable operations of the work vehicle 10 during the shift, the hydraulic shift control system 24 may predict or estimate certain operation parameters, such as engine torque loads and hydraulic pressures in a ground drive of the work vehicle 10 for the shift. In response to determining that an operation parameter to be caused by the shift exceeds a threshold value acceptable by the hydraulic system 16, the hydraulic shift control system 24 may initiate or prompt a user (e.g., an operator of the work vehicle 10) to perform one or more proactive actions to prevent the hydraulic system 16 from performing the shift, thereby avoiding potentially undesirable operations of the work vehicle 10.

For example, after receiving the instruction (e.g., instruction from a controller of an automated work vehicle or from the operator operating a work vehicle manually) for an upshift (e.g., shift from the low speed mode to the high speed mode), the hydraulic shift control system 24 may predict that the upshift may result in an increased hydraulic pressure. The increased hydraulic pressure may exceed a pressure relief limit, in which fluid flow is lost through a pressure relief valve. To prevent the hydraulic pressure from exceeding the pressure relief limit, the hydraulic shift control system 24 may automatically block the upshift and/or change a pump displacement and/or a motor displacement to avoid an increased hydraulic pressure exceeding the pressure relief limit after performing the upshift.

Figure 2:
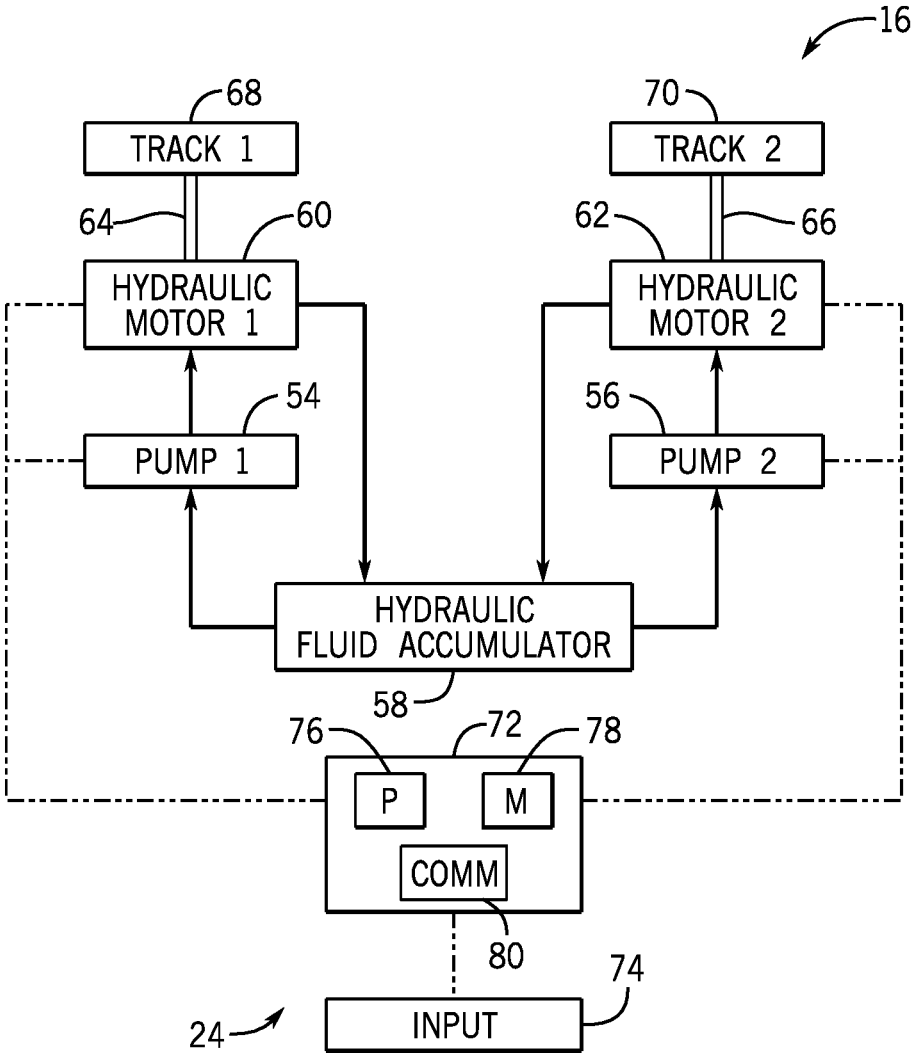
FIG. 2 is a schematic diagram of an embodiment of a hydraulic system and a hydraulic shift control system that may be used in the work vehicle of FIG. 1, in accordance with the present disclosure.

To provide further familiarity with the hydraulic control, FIG. 2 is a schematic diagram of an embodiment of a hydraulic system 16 and a hydraulic shift control system 24 that may be used in the work vehicle of FIG. 1 (e.g., the skid steer). The hydraulic system 16 may include hydraulic pumps 54, 56 that receive hydraulic fluid (e.g., oil) from a hydraulic fluid accumulator 58. The hydraulic pumps 54, 56 supply the hydraulic fluid to hydraulic motors 60, 62, respectively. Each of the hydraulic motors 60, 62 may have discrete volumes associated with respective discrete speed shifts (e.g., two, four, eight, twelve, sixteen speed shifts). As the hydraulic motors 60, 62 receive the hydraulic fluid, they drive rotation of wheels 64, 66, respectively. The wheels 64, 66 in turn couple to and rotate vehicle tracks 68, 70, respectively, causing the work vehicle 10 to move.

The components described above with regard to the hydraulic system 16 are examples and the hydraulic system 16 may include additional or fewer components relative to the illustrated embodiment. In certain embodiments, the hydraulic system 16 may include a different number of hydraulic pumps, hydraulic motors, wheels, and/or tracks (e.g., 1, 3, 4, or more). In certain embodiments, the hydraulic system 16 may include the one or more hydraulic pumps and hydraulic motors without the tracks (e.g., the work vehicle may be driven to move by wheels engaged with the ground).

In order to reduce or eliminate certain undesired operations (e.g., lurching) of the work vehicle 10 during a shift (e.g., an upshift), the hydraulic shift control system 24 is used to monitor and control operations of the hydraulic system 16. The hydraulic shift control system 24 couples to and controls operations of the hydraulic pumps 54, 56 and the hydraulic motors 60, 62. For example, the hydraulic shift control system 24 may control certain operations of the hydraulic pumps 54, 56 and the hydraulic motors 60, 62 to reduce abrupt changes in the speed of the work vehicle 10. In other words, the hydraulic shift control system 24 enables gradual changes (e.g., increase and decrease) in the speed of the work vehicle 10 in response to a shift signal.

As illustrated, the hydraulic shift control system 24 includes a controller 72 that may receive an input signal (e.g., the shift signal) from an input device 74. The input device 74 may include a joystick, touchscreen, lever, button(s), among others. The controller 72 receives and processes the input signal from the input device 74 and executes instructions stored on a memory 78 to control the operations of the hydraulic pumps 54, 56 and the hydraulic motors 60, 62. For example, the controller 72 may increase or decrease the flow rate of hydraulic fluid output by the hydraulic pumps 54, 56 and/or control the change in motor volume of the hydraulic motors 60, 62 to change the speed of the work vehicle in response to the shift signal.

The processor 76 may be a microprocessor that executes software that enables control of the hydraulic system 16. The processor 76 may include multiple microprocessors, one or more "general-purpose" microprocessors, one or more special-purpose microprocessors, and/or one or more application specific integrated circuits (ASICs), field-programmable gate arrays (FPGAs), or some combination thereof. For example, the processor 76 may include one or more reduced instruction set computer (RISC) processors.

The memory 78 may include a volatile memory, such as random access memory (RAM), and/or a nonvolatile memory, such as read-only memory (ROM). The memory 78 may store a variety of information and may be used for various purposes. For example, the memory 78 may store processor executable instructions, such as firmware or software, for the processor 76 to execute. The memory 78 may include ROM, flash memory, a hard drive, or any other suitable optical, magnetic, or solid-state storage medium or a combination thereof. The memory 78 may store data, instructions, and any other suitable data.

Additionally, the controller 72 may include a communication component 80. The communication component 80 may be a wireless or wired communication component that may facilitate communication between the controller 72 and other devices (e.g., sensors) via a network. For example, the communication component 80 may enable the controller 72 to obtain data from a variety of data sources, such as torque sensors, pressure sensors, speed sensors, and other suitable sensors measuring different operation states and/or parameters associated with the work vehicle, and the like. The communication component 80 may receive and output notifications to a user (e.g., an operator of the work vehicle 10) and/or user devices (e.g., cellphone, radio device, Bluetooth device), and/or system components (e.g., a ground drive system). The communication component 80 may use a variety of communication protocols, such as Open Database Connectivity (ODBC), TCP/IP Protocol, Distributed Relational Database Architecture (DRDA) protocol, Database Change Protocol (DCP), HTTP protocol, other suitable current or future protocols, or a combination thereof.

Figure 3:
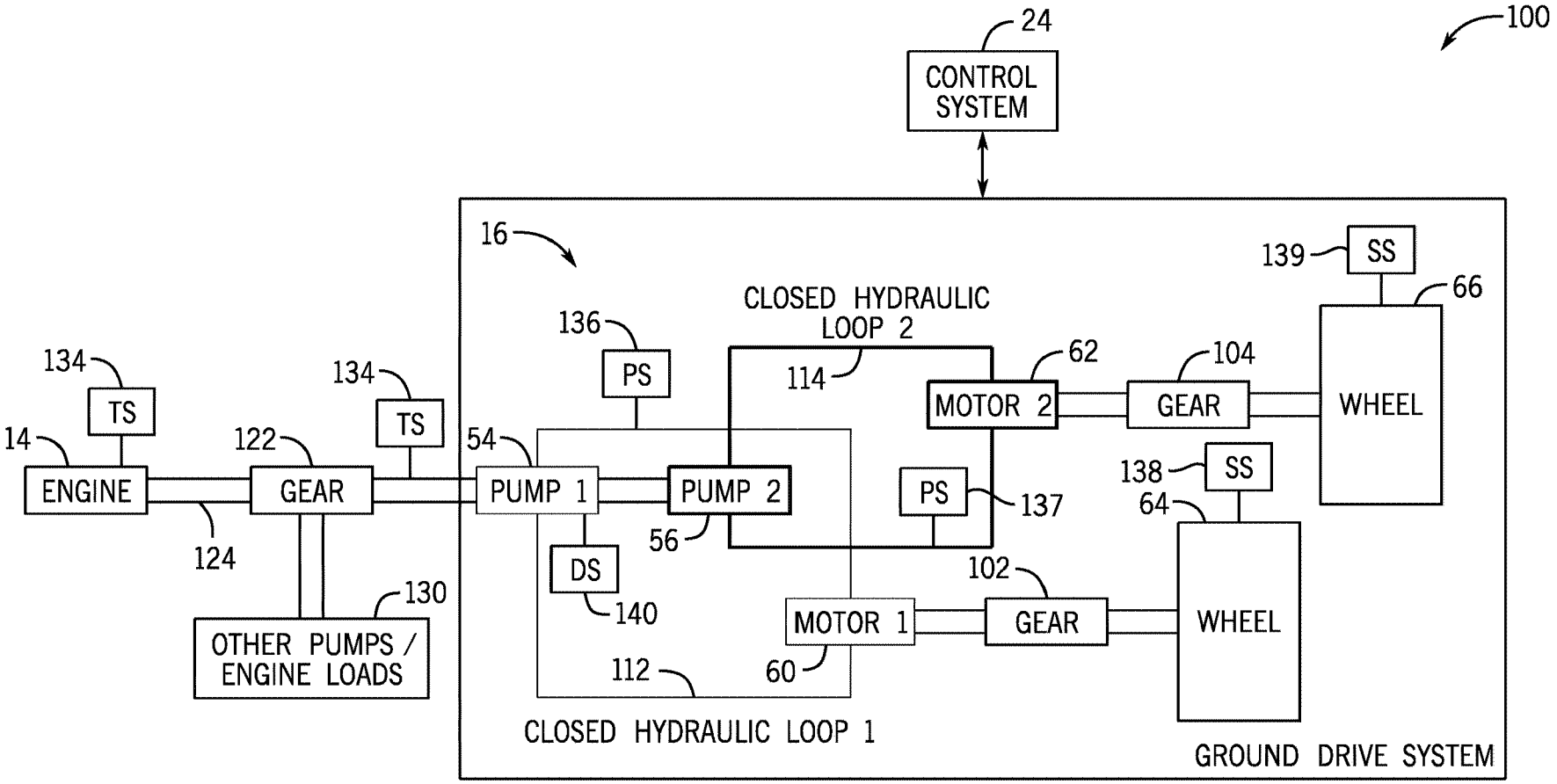
FIG. 3 is a schematic diagram of an embodiment of a ground drive system that may be used in the work vehicle of FIG. 1, in accordance with the present disclosure.

With the foregoing in mind, FIG. 3 is a schematic diagram of an embodiment of a ground drive system 100 that may be used in the work vehicle of FIG. 1. As a part of the hydraulic system 16, the ground drive system 100 may include the wheels 64, 66 coupled to the hydraulic motors 60, 62 via respective gears 102, 104. The hydraulic motors 60, 62 may couple to the hydraulic pumps 54, 56 via respective hydraulic loops 112, 114 (e.g., closed hydraulic lines). Each of the hydraulic loops 112, 114 may also include a reservoir (e.g., between the respective hydraulic motor and pump). The hydraulic pumps 54, 56 supply the hydraulic fluid to the hydraulic motors 60, 62 via the hydraulic loops 112, 114, respectively. When receiving the hydraulic fluid, the hydraulic motors 60, 62 drive rotation of the wheels 64, 66, respectively. One or more pressure relief valves may be located on the hydraulic loops 112, 114. The pressure relief valves may relieve hydraulic pressure when the hydraulic pressure (e.g., based on the estimated hydraulic pressure) exceeds a maximum pressure relief setting.

The hydraulic pumps 54, 56 may couple to the engine 14 via a gear assembly 122 (e.g., a transmission unit, a gear box) and a shaft 124 (e.g., a drive shaft). The engine 14 provides power to the hydraulic pumps 54, 56 via the gear assembly 122 and the shaft 124. The shaft 124 may deliver the torque from the engine to the gear assembly 122, and the gear assembly may deliver the torque from the shaft 124 to the hydraulic pumps 54, 56. Using the transmitted power from the engine 14, the hydraulic pumps 54, 56 drive the hydraulic motors 60, 62 to rotate via the hydraulic fluid flowing within the hydraulic loops 112, 114, respectively. Accordingly, the hydraulic motors 60, 62 drive the wheels 64, 66 to rotate, thereby driving the work vehicle 10 to move. Additionally, the gear assembly 122 may couple to other pumps and/or engine loads 130 (e.g., other hydraulic pumps, torque converter, planetary gears, clutches, and brakes) and deliver power to these components.

The hydraulic shift control system 24 may couple to the ground drive system 100 via wired communications (e.g., electrical cables) or wireless communications (e.g., radio frequency communication). The hydraulic shift control system 24 may receive (e.g., using the controller) input signals (e.g., upshift and downshift commands) from an input device accessible by a user (e.g., an operator of the work vehicle). Additionally, the hydraulic shift control system 24 may receive the input signals (e.g., sensor signals) from various sensors in different parts (e.g., at different locations) of the work vehicle.

For example, the sensors may include torque sensors (e.g., a torque sensor 134 coupled to the engine 14 and measuring engine torque), pressure sensors (e.g., pressure sensors 136, 137 coupled to the hydraulic loops 112, 114, respectively, and measuring respective hydraulic pressures of the hydraulic fluids within the respective hydraulic loops 112, 114), speed sensors (e.g., speed sensors 138, 139 measuring speeds of respective wheels 64, 66), displacement sensors (e.g., displacement sensor 140 measuring pump displacements of the hydraulic pumps 54, 56, or other pumps such as implement pumps), and other suitable sensors measuring different operation states and/or parameters associated with various components (e.g., the hydraulic motors 60, 62, the gears 102, 104) of the work vehicle.

The hydraulic shift control system 24 may process (e.g., using the controller 72) the input signals (e.g., input commands from the user, sensor data) using instructions and analytical tools (e.g., computational software, mechanical or physical model(s), simulation model(s)) stored in the memory 78. Based on the processing result (e.g., estimations, predictions), the hydraulic shift control system 24 may generate corresponding commands, instructions, or alerts to corresponding systems or components (e.g., the hydraulic system 16, the ground drive system 100, the engine 14), the user, and/or user devices (e.g., cellphone, radio device, Bluetooth device). In this way, the hydraulic shift control system 24 may control the operations of the work vehicle.

In some embodiments, the user may provide (e.g., via the input device) an upshift command to the controller of the hydraulic shift control system 24. In some embodiments, the hydraulic shift control system 24 may automatically generate the upshift command. The controller of the hydraulic shift control system 24 may use analytical tools to analyze the upshift command and determine one or more changes (e.g., speed change, engine torque change, hydraulic pressure change) that may occur in response to the upshift. Based on the analysis result, the controller of the hydraulic shift control system 24 may automatically query the received sensor data to identify relevant sensor data potentially or likely associated with the determined changes. By utilizing the analytical tools to process the relevant sensor data, the controller of the hydraulic shift control system 24 may determine a suitable change (e.g., increase) in flow rate of the hydraulic fluid produced by the hydraulic pumps 54, 56 and/or a suitable change in volume of the hydraulic motors 60, 62. Such change(s), when implemented, may change the speed of the work vehicle in response to the upshift command.

Furthermore, the controller of the hydraulic shift control system 24 may determine that an estimated/predicted change may exceed an allowable setting or threshold (e.g., a threshold hydraulic pressure, a threshold engine torque) and/or may result in certain undesired operations (e.g., lurching) of the work vehicle. In such case, the controller of the hydraulic shift control system 24 may automatically block the execution of the upshift command. Additionally, the controller of the hydraulic shift control system 24 may output (e.g., via the communication component) a notification or alert to the user to adjust or cancel the upshift command. The notification or alert may include a recommendation for adjusting the upshift command (e.g., changing to a more gradual shift to avoid abrupt changes in the speed).

The components described above with regard to the ground drive system 100 may include additional or fewer components relative to the illustrated embodiment. In certain embodiments, the ground drive system 100 may include a different number of hydraulic pumps, hydraulic motors, wheels, and/or gears. In certain embodiments, the ground drive system 100 may include one or more tracks. In certain embodiments, the ground drive system 100 may include one or more hydraulic fluid sources (e.g., the hydraulic fluid accumulator). In certain embodiments, one hydraulic pump may support two or more hydraulic motors.

With the preceding in mind, certain technologies and terms, such as those related to load dependent range shift control for the work vehicle using the hydraulic shift control system 24, are provided below to impart additional familiarity and understanding with load dependent range shift control and to provide useful real-world context for other aspects of the present disclosure.

In certain cases, there is a lack of logic to determine whether a shift (e.g., an upshift or a downshift) is acceptable for the work vehicle. In such cases, a controller of the work vehicle may simply execute a shift command (e.g., from the operator of the work vehicle). As mentioned above, executing the shift command without certain analysis (e.g., analysis of the shift command and potential outcome after executing the shift) may result in undesired operations (e.g., lurching) of the work vehicle.

To reduce or eliminate such undesired operations of the work vehicle (e.g., after receiving the shift command), the hydraulic shift control system 24 may utilize advanced shift control based on feedback data (e.g., sensor data), such as a load dependent range shift control, to predict or estimate certain operation states and/or parameters, such as engine torque loads associated with the engine, hydraulic pressures in the ground drive system 100, and the like. In response to determining that executing the shift command may result in one or more operation states and/or parameters exceeding certain corresponding threshold settings and/or values acceptable by the ground drive system 100, the controller of the hydraulic shift control system 24 may initiate one or more proactive actions (e.g., suspending or blocking) to prevent the ground drive system 100 from performing the shift in response to the shift command, thereby avoiding undesired operations of the work vehicle. Additionally, or alternatively, the controller of the hydraulic shift control system 24 may prompt a user (e.g., an operator of the work vehicle) to perform certain proactive actions (e.g., adjusting or cancelling the shift command) by automatically providing (e.g., outputting) a warning or alert.

Using the embodiment of the ground drive system 100 of FIG. 3 as an example. The ground drive system 100 includes the hydraulic pumps 54, 56 that may operate in separate circuits (e.g., pump drive circuits). Each of the hydraulic pumps 54, 56 may drive a respective hydraulic motor 60 or 62 to rotate, which drives a respective wheel 64 or 66 on one side (e.g., left or right side) of the work vehicle to rotate. Each of the hydraulic pumps 54, 56 may be connected hydraulically to the corresponding hydraulic motor (e.g., hydraulic motor 60 or 62) in a closed hydraulic loop fashion (e.g., using the hydraulic loops 112, 114). The hydraulic loops 112, 114 enable the hydraulic fluid (e.g., oil) to flow from the hydraulic pumps 54, 56 to the hydraulic motors 60, 62 and to return to the hydraulic pumps 54, 56 (e.g., via pump inlets). The hydraulic fluid may continue to cycle in this manner.

Each of the hydraulic motors 60, 62 is connected to a corresponding wheel 64 or 66 via a corresponding gear 102 or 104. In the illustrated embodiment, the hydraulic pump 54 drives the hydraulic motor 60 via the hydraulic loop 112, which in turn drives the wheel 64 on the left side of the work vehicle. Similarly, the hydraulic pump 56 drives the hydraulic motor 62 via the hydraulic loop 114, which in turn drives the wheel 66 on the right side of the work vehicle. The hydraulic pumps 54, 56 may be variable displacement pumps (e.g., with adjustable pump displacement). The hydraulic shift control system 24 may use the pump displacement as a control input. For example, the controller of the hydraulic shift control system 24 may use the pump displacement to determine or predict pump flow (e.g., flow amount and/or rate) of the hydraulic fluid being or to be provided to the hydraulic motors 60, 62, speeds of the hydraulic motors 60, 62, and so on. For example, the controller of the hydraulic shift control system 24 may determine the pump flow based on a pump speed (correlating to an engine speed) and the pump displacement.

With the setup described above, the hydraulic shift control system 24 may control the hydraulic pumps 54, 56 to control the speed of the work vehicle (e.g., in a continuous manner or in discrete increments) (e.g., from zero speed (corresponding to a zero pump flow) to maximum speed (corresponding to a maximum pump flow)). In some embodiments, the hydraulic motors 60, 62 may also be variable displacement (e.g., with continuous control of displacement setting or with discrete displacement setting). In some embodiments, the hydraulic motors 60, 62 may have discrete displacement settings (e.g., 2 discrete displacement setting for skid steer loaders) In some embodiments, the hydraulic motors 60, 62 may have a fixed single displacement setting.

The various methods described below are related to the work vehicle having two discrete displacement settings for two hydraulic motors (e.g., the hydraulic motors 60, 62). However, the described methods may be applied to other scenarios mentioned above, such as the hydraulic motors 60, 62 having variable displacement with continuous control of the displacement setting, more than two discrete displacement settings (e.g., 3, 4, 5, 6, 7, 8, 12, 16, or more discrete displacement settings) for different work vehicles (e.g., dozers, dozer loaders), having the fixed single displacement setting, or the like.

In certain embodiments, the operator may control the pump displacement (and hence vehicle speed) by shifting through predefined incremental speed settings, which correlate to predefined incremental pump displacements. The increments may be limited to 2 increments, 4 increments, 8 increments, or 16 increments, or the increments may be infinite (giving continuous control).

In addition to changing the pump displacement for each of the discrete speed settings, the hydraulic shift control system 24 may change the motor displacement of the hydraulic motors 60, 62, which have adjustable pump displacements. For example, the hydraulic shift control system 24 may solely use the hydraulic pumps 54, 56 to control the vehicle speed until the pump displacements are raised to 100 percent of a threshold (e.g., a maximum pump displacement), while keeping the hydraulic motors 60, 62 at maximum motor displacement at low speeds. In this situation, the hydraulic motors 60, 62 may have maximum torque at the maximum motor displacement. However, when the pump displacements are no longer increased due to reaching the maximum displacement, the hydraulic shift control system 24 may change the motor displacement to increase the vehicle speed. For example, the hydraulic shift control system 24 may reduce the motor displacement to cause the hydraulic motors 60, 62 to spin faster, thereby increasing the vehicle speed.

In other words, for a system (e.g., hydraulic system or ground drive system) having variable displacement motors, the vehicle speed may be controlled, for an upshift example, by first increasing the pump flow rate to a maximum pump flow rate (e.g., corresponding to the maximum pump displacement) while keeping hydraulic motors at the maximum motor displacement, and then reducing motor displacement to a minimum motor displacement to reach a target vehicle speed (e.g. based on the shift command). In this way, for a given vehicle speed, a ground drive torque may be constantly kept to a maximum value for the given vehicle speed. To prevent certain undesired operations of the work vehicle during a shift operation resulted from, for example, an increased hydraulic pressure exceeding a threshold (e.g., a pressure relief limit), the hydraulic shift control system 24 may automatically block the shift operation and/or change a pump displacement and/or a motor displacement to avoid the increased hydraulic pressure.

For a continuous system (e.g., having a continuous speed shift instead of the discrete speed settings), the vehicle speed may be controlled in a smooth way, such as a continuous adjustable range from zero speed (corresponding to the zero pump flow and the maximum motor displacement) to a maximum speed (corresponding to the maximum pump flow and the minimum motor displacement).

For a system having the hydraulic motor 60, 62 with fixed displacements, the hydraulic shift control system 24 may solely control the vehicle speed via the hydraulic pumps 54, 56. In such a system, similar methods, such as changing the pump displacement for each of the discrete speed settings, may still be applied without a reduction in motor displacement due to the fixed displacement of the hydraulic motors 60, 62.

In certain embodiments using the system having the variable displacement motors, certain undesired changes (e.g. abrupt changes in the speed of the work vehicle) may occur during a shift. The work vehicle may have two or more (e.g., 4, 6, 8, 12, 16) speed settings. As mentioned above, in response to a shift command (e.g., an upshift), the controller the hydraulic shift control system 24 may first increase the pump flow rate of the hydraulic pumps 54, 56 to increase the vehicle speed until the pump displacement reaches the maximum allowable pump displacement (while keeping the motor displacement at the maximum displacement), and then reducing motor displacement to continue increasing the vehicle speed. However, when shifting from one discrete speed setting (e.g., speed setting 8 in a low range of a system having 16 speed settings) to another discrete speed setting (e.g., setting 9 in a high range of the system), reducing the motor displacement from a higher value (e.g., the maximum displacement corresponding to the low range) to a lower value (e.g., a displacement corresponding to the high range) may cause the engine to stall due to the hydraulic pumps 54, 56 applying too much torque to the engine and losing hydraulic fluid when the hydraulic fluid pressure exceeds a threshold (e.g., a relief valve threshold), resulting in a sudden change (e.g., jump) in vehicle speed, causing certain undesired operations (e.g., lurching) of the work vehicle.

To reduce or eliminate such engine stall and resulting abrupt changes (e.g., the sudden jump in vehicle speed), the hydraulic shift control system 24 may utilize the feedback data (e.g., sensor data) to predict or estimate certain operation states and/or parameters, such as the hydraulic pressures in the ground drive system 100, engine torque loads associated with the engine 14, and the like.

For example, the work vehicle speed range may be divided into discrete preset (or preconfigured, predefined) speed settings (e.g., 2, 4, 6, 8, 12, 16, or more preset speed settings) with corresponding predetermined settings for the pumps (e.g., hydraulic pumps 54, 56) and motors (e.g., hydraulic motors 60, 62). Such settings, when plotted (e.g., predetermined pump displacements versus preconfigured wheel speeds, or predetermined motor volumes versus the preconfigured wheel speeds), may fall on paths of continuous curves.

The work vehicle speed may be a function of the pump speed (correlating to an engine speed) and selected hydraulic gears. For example, the hydraulic gears may be created by discretizing continuously variable pump volume into fixed settings through which an operator may increment, thereby increasing the work vehicle speed by increasing the pump volume.

Additionally, or alternatively, the motor volume (e.g., for dual displacement motor) may be used to adjust the work vehicle speed. For example, the work vehicle speed may be split into a low and high speed range by selecting high or low motor displacement setting. The high motor displacement may result in low ground speed and high drive torque capacity, and the low motor displacement may result in high ground speed and low drive torque capacity.

In certain embodiments, the hydraulic motor may start at a high volume setting for low vehicle speeds and the pump volume may increment up with each speed level. When the pump volume increase to a maximum volume, the hydraulic motor may shift to a low volume setting and the pump volume may decrease, resulting in an incremental vehicle speed higher than the last speed achieved with the motor in high volume setting. The pump volume could then continue to increment to increase vehicle speed. The motor torque may be limited in capacity by a ratio of the motor volume before and after the shift.

Figure 4:
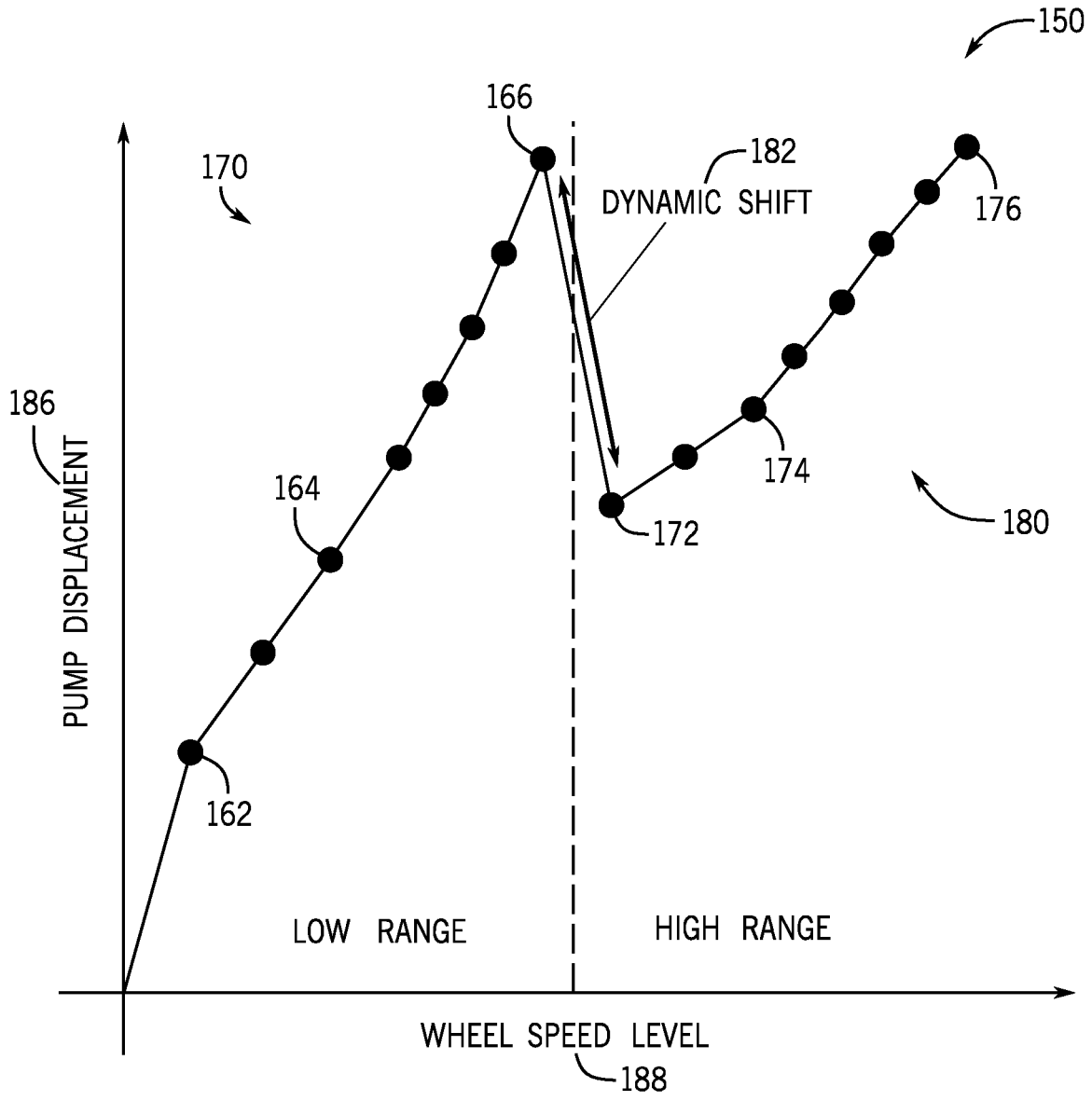
FIG. 4 is a graph of an embodiment of a shift progression that may be performed by the hydraulic shift control system of FIG. 2, in accordance with the present disclosure.

With this in mind, FIG. 4 is a graph 150 of an embodiment of a shift progression that may be performed by the hydraulic shift control system. In the graph 150, the hydraulic shift control system has 16 discrete speed settings. Among them, speed settings 1-8 (corresponding to 8 data points, such as data points 162, 164, 166) are in a low range 170, and speed settings 9-16 (corresponding to 8 other data points, such as data points 172, 174, 176) are in a high range 180. For example, the data point 162 corresponds to the speed setting 1 that represents the lowest preset speed of the work vehicle 10, and the data point 166 corresponds to the speed setting 8 that represents an intermediate preset high speed of the work vehicle 10 in the low range 170. Similarly, the data point 172 corresponds to the speed setting 9 that represents a low intermediate preset speed of the work vehicle 10 in the high range 180, and the data point 176 corresponds to the speed setting 16 that represents the highest preset speed of the work vehicle.

In the present embodiment, the low range 170 may correspond to low ground drive speeds (i.e., low wheel speeds), high ground drive torque, high motor volumes, and so on. The high range 180 may correspond to high ground drive speed (i.e., high wheel speeds), low ground drive torque, low motor volume, and so forth.

Based on the speed settings (e.g., speed settings 1-16), the hydraulic shift control system may determine the pump displacements corresponding to the speed settings. The determined pump displacement versus wheel speeds may be plotted, as shown in the graph 150, in which an axis 186 represents the pump displacement and an axis 188 represents the speed (e.g., wheel speed level). In the low range 170 and the high range 180, the corresponding data points (e.g., 162-166, or 172-176) fall on respective paths of continuous curves. Similarly, other operation states/parameters, such as motor volumes, may be determined and plotted (e.g., the motor volume versus the wheel speed). Based on such graphs (e.g., graph 150), the hydraulic shift control system may determine certain relations (e.g., correlation(s) in magnitude(s) and/or trend(s) between the pump displacement or the motor volume and the vehicle speeds) and utilize such relations to perform the load dependent range shift control.

In the present embodiment, the work vehicle (e.g., a dozer) has 16 discrete speed settings (e.g., speed settings 1-16). After receiving an upshift command, the hydraulic shift control system may set the hydraulic motors at a maximum motor displacement for the speed settings 1-8 in the low range 170, and then transition to a lower motor displacement setting for the speed settings 9-16 in the high range 180. When transitioning from the speed setting 8 to the speed setting 9, in order to substantially reduce or eliminate a sudden jump in vehicle speed, the hydraulic shift control system may reduce the pump displacement by an amount of pump displacement that gives a desired vehicle speed for the speed setting 9. Simultaneously, the hydraulic shift control system may shift (e.g., via a dynamic shift mechanism, as shown in a transition range 182 between the low range 170 and the high range 180) the hydraulic motors from the maximum motor displacement to the lower motor displacement setting. Next, the hydraulic shift control system may incrementally increase the pump displacement (e.g., up to 100 percent of the maximum pump displacement) to reach the desired vehicle speed for the speed setting 10-16.

A similar strategy may be applied to a downshift (i.e., reducing the vehicle speed) for changing from a higher speed setting (e.g., speed setting 9) to a lower speed setting (e.g., speed setting 8). In such a case, similar methods with inverse logic (e.g., first decreasing the pump flow rate and then increasing the motor displacement).

Figure 5:
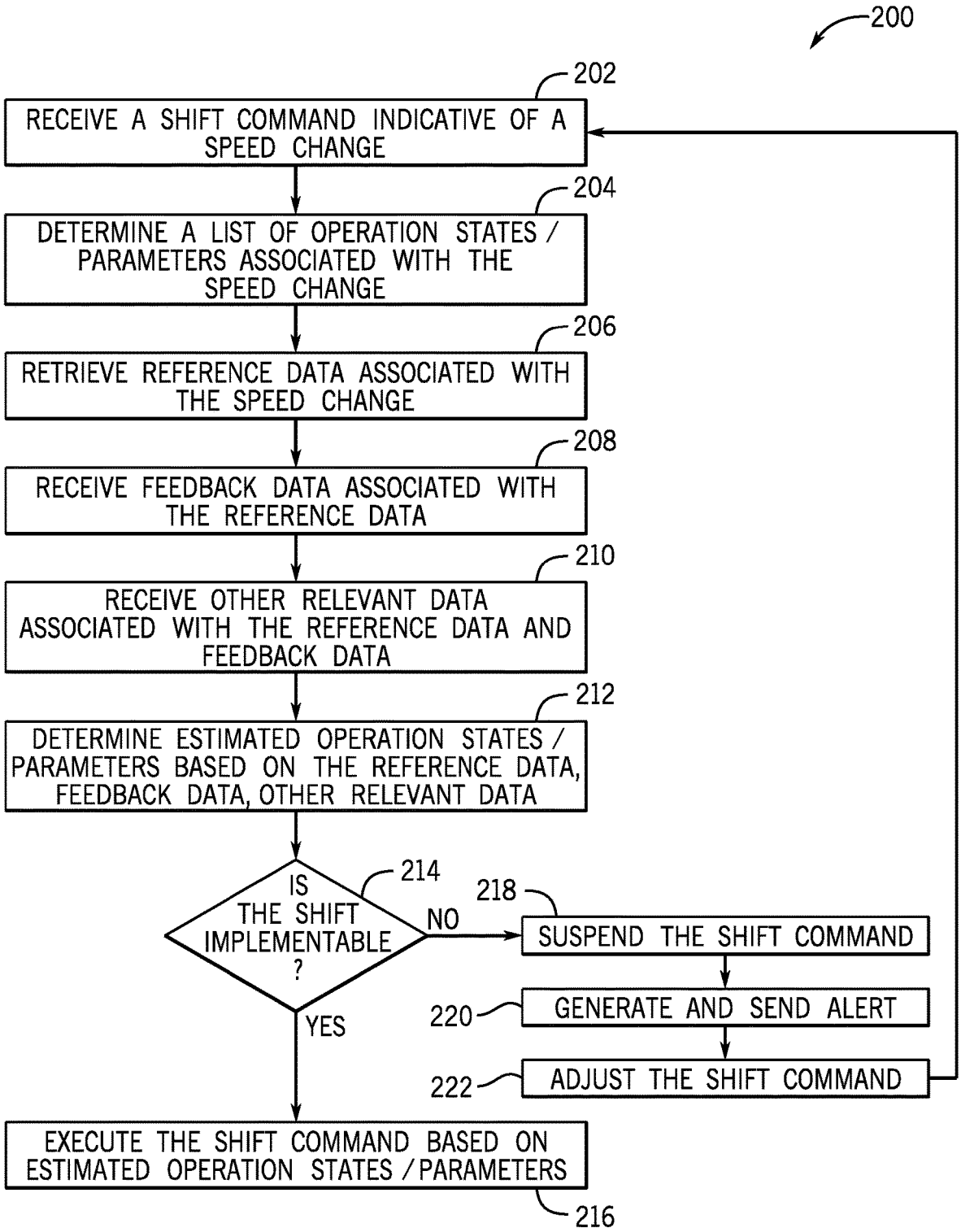
FIG. 5 is a flow diagram of an embodiment of a method for load dependent range shift control using the hydraulic shift control system of FIG. 2, in accordance with the present disclosure.

With the preceding in mind, FIG. 5 is a flow diagram of an embodiment of a method 200 for load dependent range shift control using the hydraulic shift control system of FIG. 2. The hydraulic shift control system may perform operations described below via the controller disclosed above (e.g., using the processor, memory, other components such as the communication component) based on processor-executable code stored in the memory. For example, the processor may execute the processor-executable code to perform the load dependent range shift control based on the sensor data, simulation data, configuration data (e.g., engine, pump, and motor manuals stored in the memory), or any combination thereof. Further, the processor may output alerts/recommendations via the communication component to a user or a user device to prompt the user to be aware of certain conditions and/or outcomes (e.g., associated with one or more actions to be performed the work vehicle) and/or to prompt the user to take certain actions.

Although the method 200 is described in a particular order, the method 200 may be performed in any suitable order and is not limited to the order presented herein. It should also be noted that although each processing block is described below in the method 200 as being performed by the controller disclosed above, other suitable computing systems or devices may perform the methods described herein.

Referring now to FIG. 5, at block 202, the controller may receive a shift command indicative of a speed change (e.g., speed increase or decrease) of the work vehicle. For example, the shift command may include implementing an upshift to shift the vehicle speed from the low range to the high range. The controller may receive the upshift command from a user (e.g., an operator of the work vehicle) via the communication component and/or a Controller Area Network (CAN), such as a communication system for vehicle intercommunications. If the work vehicle is an unmanned vehicle (e.g., using robotic or artificial intelligence (AI) techniques), the controller may determine an upshift is desired or may receive the upshift command from a corresponding robotic or AI controller automating the operations of the work vehicle.

At block 204, the controller may determine a list of operation states and/or parameters associated with the speed change. The list of operation states and/or parameters may include, but are not limited to, pump displacements (e.g., associated with the hydraulic pumps), engine torque (e.g., associated with the engine), ground drive torque (e.g., associated with the ground drive system), hydraulic pressures (e.g., associated with the hydraulic pumps, the hydraulic motors), and so on.

Based on the list of operation states and/or parameters associated with the speed change, at block 206, the controller may retrieve reference data associated with the speed change. For example, the controller may access a database (e.g., stored in the memory) to retrieve the reference data. The reference data may include data (e.g., precomputed data, predefined data), such as speed settings with corresponding pump and motor settings (e.g., pump displacement settings, motor volume settings), engine torque versus engine speed curve(s), motor torque versus motor speed curve(s), motor displacement versus motor speed curve(s), pump displacement versus pump speed curve(s), pump displacement versus hydraulic pressure curve(s), and the like.

At block 208, the controller may receive feedback data associated with the speed change. The feedback data may include sensor data related to the speed change, such as torque data (e.g. measured torques associated with the engine, the shaft, the hydraulic motors), pressure data (e.g., measured hydraulic pressures associated with the hydraulic pumps, the hydraulic loops, other hydraulic pumps or components, other hydraulic lines), speed data (e.g., measured speeds associated with the wheels), displacement data (e.g., measured pump displacements associated with the hydraulic pumps and/or other implement pumps), and so on.

Additionally or alternatively, at block 210, the controller may receive other relevant data associated with the reference data and/or feedback data. For example, the relevant data may include modeling data related to the reference data or feedback data, such as simulation data associated with various operations of ground drive pumps (e.g., hydraulic pumps), implement pumps (e.g., pumps driving the hydraulic actuators), other auxiliary system components (e.g., pumps, motors) using hydraulic forces, and so on. In certain embodiments, the controller may cause the processor or other computing devices to run the modeling and simulations mentioned above using various suitable models. For example, the models may include mechanical models, physics models, other mathematical models that may simulate operations of the engine, the hydraulic pumps, implement pumps (e.g., pumps driving the hydraulic actuators), the hydraulic motors, other auxiliary system components (e.g., auxiliary pumps and/or motors), and so on.

In some embodiments, the processor or other computing devices may execute the modeling and simulations using the configuration data (e.g., the speed settings with corresponding pump and motor settings, data derived from the engine torque versus engine speed curves, motor torque versus motor speed curves, motor displacement versus motor speed curves, pump displacement versus hydraulic pressure curves). Additionally or alternatively, the processor or other computing devices may run the modeling and simulations using the feedback data.

Based on the reference data, the feedback data, and the other relevant data, at block 212, the controller may determine estimated operation states and/or parameters using different methods implemented in different processes. Such processes may be performed (e.g., via the processor) individually, sequentially, or in parallel, depending on the relations of the estimated operation states and/or parameters.

For example, the controller may estimate a hydraulic pressure to determine whether there is sufficient pressure reserve in the hydraulic system before allowing the hydraulic system to shift the gear (e.g., that may result in a hydraulic torque limitation due to pressure being relieved through a hydraulic relief valve). In response to determining that the shift may result in the hydraulic pressure exceeding a threshold, the hydraulic shift control system may prevent the work vehicle from shifting into a higher speed range that may stall the engine or the ground drive. In some embodiments, the controller may estimate an engine torque to determine whether there is sufficient torque reserve in the engine before allowing the hydraulic system to shift to a higher gear. The torque reserve may be calculated with the reference data associated with peak engine torque or some reference torque corresponding to an allowable droop in engine rpm from increased load torque. In such cases, the hydraulic pressure or the engine torque may be estimated for the shift in the ground drive gears.

Certain methods may be used to estimate a motor hydraulic pressure. For example, the controller may estimate the motor hydraulic pressure based on direct pressure measurement from pressure sensors positioned on both sides of a hydraulic motor. In some embodiments, the controller may estimate the motor hydraulic pressure based on estimated engine torque using the following equations:

$$T_{eng}=T_{hyd}+T_{other}+dT_{shift} \quad (1),$$

$$T_{hyd}=T_{pump1}+T_{pump2}+dT_{shift} \quad (2),$$

$$T_{pmp}=f(V,dp,n),\ dp \text{ may be from a table or model} \quad (3),$$

$$T_{pmp}\approx V*dp/(2\pi), \quad (4),$$

$$dp=P_{hi}-P_{low} \quad (5),$$

$$P_{low}=\text{known work vehicle constant setting} \quad (6),$$

$$P_{hi}=dp+P_{low} \quad (7),$$

where $T_{eng}$ is engine torque, $T_{hyd}$ is hydraulic torque from ground drive pumps acting on the engine, $T_{other}$ is estimation of other torque on the engine from fan, loader hydraulics, alternator, and so on, $dT_{shift}$ is delta (change) of torque on the engine for an upshift in speed setting gear, $T_{pump1}$ and $T_{pump2}$ are torque of ground drive pump 1 and 2, respectively, V is volume of individual pump, dp is delta pressure across hydraulic pump, n is rotational speed of hydraulic pump, dp may be found from a table when V and n are known values and $T_{pmp}$ has been estimated from engine load, $P_{low}$ is hydraulic pressure on low pressure side of pump, and $P_{hi}$ is hydraulic pressure on high pressure side of pump.

In some embodiments, the controller may estimate the engine torque based on direct measurement of engine torque from torque sensors or feedback from an engine controller. In some embodiments, the controller may estimate the engine torque using the equations (1)-(7) and the following equation:

$$T_{eng}=T_{hyd}+T_{other} \quad (8).$$

In some embodiments, the controller may estimate the engine torque based on measured engine speed compared to commanded speed (e.g., using an engine torque versus engine speed curve). For example, a drop in engine speed may correspond to the engine operating on the maximum torque curve, which may allow the engine torque to be estimated by referencing the engine torque versus engine speed curve and the measured speed.

Additionally, or alternatively, the controller may estimate a pump volume. For example, the controller may estimate the pump volume based on direct measurement of a swash plate angle. In some embodiments, the controller may estimate the pump volume based on an assumption that a commanded pump volume is accurate (e.g., using pump specifications). In some embodiments, the controller may use wheel speed feedback data and engine speed feedback data with known vehicle data to estimate the pump flow. In some embodiments, the controller may use vehicle speed from GPS or radar sensor to estimate the wheel speed and then estimate the pump volume.

In certain embodiments, the controller may estimate pump displacements based on the reference data and the feedback data. For example, the controller may estimate the pump displacements based on the reference data including displacement data derived from the preconfigured settings (e.g., wheel speed settings, engine speed settings, hydraulic pump speed settings, hydraulic motor settings) and the feedback data including speed data acquired by pump speed sensors. Additionally or alternatively, the controller may estimate the pump displacements based on the reference data including displacement data derived from the pump displacements versus hydraulic pressure curve and the feedback data including hydraulic data acquired by the pressure sensors coupled to the hydraulic loops.

In certain embodiments, the controller may estimate an engine torque that the hydraulic pumps place on the engine. For example, the controller may estimate the engine torque based on the reference data including the torque data derived from the motor torque versus motor speed curves, the feedback data including the measured speeds of the hydraulic motors, and so on.

In certain embodiments, the controller may estimate a ground drive torque. The ground drive torque may be a function of a hydraulic pressure (e.g., within the hydraulic loops) and a motor displacement. The controller may estimate the ground drive torque based on the hydraulic pressure and the motor displacement. For example, the hydraulic pressure may be limited by a pressure relief valve. Therefore, the maximum ground drive torque may be limited by the maximum hydraulic pressure (e.g., preconfigured based on the pressure relief valve) and the motor displacement.

In certain cases, a higher torque may be desired for a higher vehicle speed in order to overcome (e.g., compensate for) certain conditions/limits (e.g., speed dependent resistive loads). For such cases, the controller may estimate a hydraulic pressure corresponding to the requested shift (e.g., upshift). For example, the controller may estimate the hydraulic pressure after the upshift is complete based on the feedback data including the torque data and the displacement data associated with the hydraulic pumps. In response to a determination that a resulting hydraulic pressure (based on the estimated hydraulic pressure) may exceed a maximum pressure relief setting (e.g., preconfigured based on the pressure relief valve), the controller may block (e.g., suspend) the upshift, resulting in a reduced ground drive torque that reduces the ground drive speed, instead of achieving the requested speed increase.

In certain embodiments, the controller may estimate a total engine torque and contributions of the hydraulic pumps to the total engine torque for a subsequent operation (e.g., a shift) or a subsequent gear setting associated with the shift based on the hydraulic pressure and pump volume. For example, the controller may use feedback data including the pressure data (e.g., measured hydraulic pressures associated with the hydraulic pumps or the hydraulic loops), and the displacement data (e.g., measured pump displacements associated with the hydraulic pumps) to estimate the total engine torque. In another example, the controller may estimate a total engine torque, a pump torque, and a motor torque based on the hydraulic pressure and motor volume.

In some of the embodiments described above, the controller utilizes the feedback data for estimations of the operation states and/or parameters, such as the states of the hydraulic pumps and hydraulic motors. Various sensing methods may be used to acquire the feedback data. For example, the hydraulic pressures of the hydraulic pumps and motors may be measured directly with pressure sensors, and the volumes of the hydraulic pumps and motors may be measured directly with pump displacement sensors. In some cases, the volumes of the hydraulic pumps and motors may also be estimated using known relationships (e.g., stored in the memory) between the shift command to the hydraulic pumps or motors and resulting displacements. In some cases, torque sensors may be placed directly on shafts of the hydraulic pump/motors to measure the pump/motor torques. In some cases (e.g., with no pressure sensor(s)), the controller may estimate the hydraulic pressure based on the engine load. For example, the controller may determine torque applied to a hydraulic pump, then use the measured or commanded displacement of the hydraulic pump to determine corresponding pressure for the torque.

In certain embodiments, the controller may estimate an engine torque (e.g., an instantaneous engine torque) using different methods with corresponding reference data. In one example, the controller may receive a determined value of the instantaneous engine torque from the engine controller (e.g., via a Controller Area Network (CAN)). In another example, the controller may estimate the instantaneous engine torque based on the engine torque versus engine speed curve (e.g., in a manual of the engine stored in the memory) and measured speeds of the engine (e.g., from the speed sensors).

In certain embodiments, the controller may estimate the engine torque with no direct feedback data (e.g., from the feedback of the torque sensor on the engine). For example, the controller may estimate the engine torque based on a sum of torques, including ground drive pump torques, implement pump torques, auxiliary system component torques, and parasitic torques of the engine. Such torques may be determined based on the other relevant data including the modeling data. The controller may use various simulations to generate the modeling data and store the modeling data in the memory. The simulations may include using models (e.g., mechanical models, physics models, other mathematical models) to simulate operations of ground drive pumps (e.g., hydraulic pumps), implement pumps (e.g., pumps driving the hydraulic actuators), other auxiliary system components (e.g., pumps, motors), and so on. The simulations may use the reference data (e.g., torque data derived from pump torque versus pump speed curves) associated with the speed change. Based on the simulation results, the controller may determine an estimated sum of torques.

In certain embodiments, the controller may estimate the engine torque by determining an increased engine torque at a ground drive pump (e.g., hydraulic pump) when other loads (e.g., at the implement pumps and/or other auxiliary system components) are unchanged.

For a pair of hydraulically connected pump and motor, such as the hydraulic pump connected hydraulically to the corresponding hydraulic motor in a closed hydraulic loop fashion (e.g., using the hydraulic loop), the controller may estimate pump or motor torques based on estimations of the pump or motor displacement and the pump or motor pressure. Because the pump and motor are hydraulically connected, the pressure is substantially the same for the pump and the motor. The torque for the pump or motor may be based on (e.g., proportional to) the pump or motor pressure and the pump or motor displacement. The relationship between the pump or motor pressure and the pump or motor torque may be determined based on theoretical calculations or modeling using empirical or physics based models of the pump or motor.

After estimating certain instantaneous states (e.g., pump and motor torque) of the hydraulic pumps and hydraulic motors, the controller may predict other states during the shift (e.g., the upshift). For a constant ground drive load, an increase in the hydraulic pressure may be proportional to a decrease in motor displacement associated with the shift if a constant speed is maintained. Additionally, a torque rise may be associated with increased resistance at higher speeds (e.g., in the high range). The torque rise may be modeled using empirical or physics based models of the hydraulic pumps or motors. The torque rise may cause the hydraulic pressure to rise (e.g., proportionally).

As discussed above, various methods may be used to estimate or predict the torque of the engine and the hydraulic pressure. Additionally or alternatively, instead of predicting the load (e.g., load at a next gear setting), the controller may set thresholds for the current gear to block the upshift if either the engine torque or hydraulic pressure is above a threshold.

At block 214, the controller may determine whether the shift is implementable. For example, the controller may estimate the engine torque corresponding to a subsequent speed and determine whether the engine torque is less than a threshold torque. Alternatively, the controller may estimate the hydraulic pressure corresponding to the subsequent speed and determine whether the hydraulic pressure is less than a threshold pressure (e.g., a relief valve threshold). In response to a determination that the shift is implementable (e.g., resulting in desired outcomes), at block 216, the controller may execute the shift command based on the estimated operation states and/or parameters. For example, the controller may cause the ground drive system to gradually change a speed of the work vehicle during the shift by controlling hydraulic motor volumes of the hydraulic motors and hydraulic fluid volumes pumped by the hydraulic pumps based on the estimated operation states and/or parameters.

In embodiments having discrete predetermined speed settings (e.g., speed settings 1-16), after receiving an upshift command, the controller may set the hydraulic motors at a maximum motor displacement for a lower speed setting (e.g., speed setting 8 in the low range) based on the reference data including motor displacements for the low range. The controller may then control the hydraulic motors to transition to a lower motor displacement setting for a higher speed setting (e.g. speed setting 9 in the high range) based on the reference data including motor displacements for the high range.

During the transition, to substantially reduce or eliminate the possibility of a sudden speed increase, the controller may cause a hydraulic pump to reduce a current pump displacement (e.g., based on feedback data from the displacement sensor) by an estimated amount of pump displacement (e.g., based on the reference data including preconfigured pump displacements) that may result in a desired vehicle speed for the speed setting 9 (e.g., based on estimated pump displacements and corresponding speeds). Concurrently (e.g., slightly before, slightly after, or simultaneously), the controller may shift the hydraulic motors from the maximum motor displacement to the lower motor displacement setting. After the transition, the controller may control the hydraulic pumps to incrementally increase the pump displacement until reaching the desired vehicle speed.

In certain embodiments, based on the estimated ground drive torque, the controller may control the hydraulic motors (either dual displacements or continuously variable hydraulic motors) to decrease the motor displacement and control the hydraulic pumps to increase the hydraulic pressure, thereby substantially maintaining the ground drive torque.

In certain embodiments, based on the predetermined or estimated engine torque, the controller may control the engine to achieve a desired engine torque for the shift. For example, the controller may receive a value of the instantaneous engine torque from the engine controller (e.g., via a Controller Area Network (CAN)). For another example, the controller may estimate the instantaneous engine torque based on the engine torque versus engine speed curve (e.g., stored in the memory) and measured speeds of the wheels (e.g., from the speed sensors). The engine speed may drop below the commanded engine speed (e.g., due to the torque load applied to the engine exceeding the torque capacity of the engine for the commanded speed). Therefore, the engine torque may be determined based on the actual engine speed relative to the commanded engine speed.

In response to a determination that the shift is not implementable (e.g., estimate engine torque corresponding to a subsequent speed is greater than a threshold torque, or estimated hydraulic pressure corresponding to the subsequent speed is greater than a threshold pressure), at block 218, the controller may suspend the shift command. For example, the controller may not generate an instruction to the ground drive system for performing the shift. Further, based on the estimations described above (e.g., estimated torques and hydraulic pressures), the controller may perform preventive or proactive actions to eliminate or reduce the undesired operations (e.g., engine stall) of the work vehicle.

Additionally or alternatively, at block 220, the controller may generate and output alerts associated with not executing the shift command. For example, the alerts may include reasons for not executing the shift command. In certain cases, the reasons may indicate that an estimated engine torque may exceed a capacity of an engine if the shift is performed. In other cases, the reasons may indicate a resulting hydraulic pressure (e.g., based on the estimated hydraulic pressure) exceeds a maximum pressure relief setting (e.g., based on the pressure at which the pressure relief valve relieves pressure).

Additionally or alternatively, at block 222, the controller may adjust the shift command. For example, the adjustments may include modifying certain requested operation parameters specified in the shift command, such as requested speed increase magnitude, timing, or the like. The adjusted shift command, if executed, may result in different outcomes, such as desired engine torque, hydraulic pump/motor pressure, ground drive torque, or a combination thereof, which may achieve the requested speed increase and avoid the undesired operations (e.g., operations that may result in an engine torque exceeding a threshold torque, or loss of hydraulic fluid through a relief valve due to a hydraulic pressure exceeding a threshold pressure) of the work vehicle if executing the original shift command.

Technical effects of the present disclosure include a hydraulic shift control system that enables a work vehicle (e.g., small dozers and skid steer loaders having dual displacement motors) to smoothly change speeds during a shift (e.g., an upshift or a downshift) and substantially reduce or eliminate abrupt changes (e.g., sudden jump in vehicle speed) associated with a shift operation that may cause an engine torque exceeding a threshold torque, or a hydraulic pressure exceeding a threshold pressure. The hydraulic shift control system may predict these problematic scenarios and prevent shifting that may cause unacceptable outcomes for the work vehicle.

The hydraulic shift control system may utilize (e.g., analyze, process, simulate) various reference data, feedback data (e.g., sensor data), other relevant data (e.g., model simulation data) to predict or estimate certain operation states and/or parameters (e.g., engine torque loads associated with an engine, hydraulic pressures in the hydraulic system and/or the ground drive system). For example, based on the data mentioned above, the hydraulic shift control system may estimate a torque associated with a shift to be performed by the hydraulic system. In response to determining that the predicted torque caused by the shift exceeds a threshold torque acceptable by the engine, the hydraulic shift control system may perform proactive actions to prevent the hydraulic system from performing the shift, thus substantially reducing or eliminating the possibility of potential undesirable outcomes for the work vehicle.

As used herein, the terms "inner" and "outer"; "up" and "down"; "upper" and "lower"; "upward" and "downward"; "above" and "below"; "inward" and "outward"; and other like terms refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A work vehicle, comprising:

a hydraulic system, comprising:

a hydraulic motor configured to drive one or more wheels of the work vehicle;

a hydraulic pump configured to pump hydraulic fluid to the hydraulic motor; and a hydraulic shift control system comprising a controller having a memory and a processor, wherein the controller is configured to:

receive vehicle data associated with a shift command indicative of a shift operation;

generate prediction data by estimating one or more vehicle operation parameters based on the vehicle data;

determine whether the shift operation is implementable based on the prediction data; and in response to determining that the shift operation is implementable, control the hydraulic system to perform the shift operation.

2. The work vehicle of claim 1, wherein the hydraulic shift control system is configured to cause the hydraulic system to change a speed of the work vehicle from a first speed to a second speed during the shift operation.

3. The work vehicle of claim 2, wherein the shift command comprises an upshift command, and the first speed is lower than the second speed.

4. The work vehicle of claim 2, wherein the shift command comprises a downshift command, and the first speed is higher than the second speed.

5. The work vehicle of claim 2, wherein the hydraulic shift control system is configured to block the hydraulic system to change the speed of the work vehicle in response to determining that changing the speed is not implementable.

6. The work vehicle of claim 1, wherein the controller is configured to control the hydraulic system to perform the shift operation by adjusting a motor volume of the hydraulic motor, adjusting a fluid volume of the hydraulic pump, or a combination thereof.

7. The work vehicle of claim 1, wherein the hydraulic motor comprises a continuous motor having a continuously adjustable displacement or a displacement motor having a plurality of motor displacement settings.

8. The work vehicle of claim 1, wherein the hydraulic pump comprises a continuous pump having a continuously adjustable displacement or a displacement pump having a plurality of pump displacement settings.

9. The work vehicle of claim 1, wherein the vehicle data comprises reference data associated with the shift operation, and the reference data comprises data associated with speed settings, pump displacement settings, pump volume settings, motor displacement settings, motor volume settings, one or more engine torque versus engine speed curves associated with an engine of the work vehicle, one or more motor torque versus motor speed curves, one or more motor displacement versus motor speed curves, one or more pump displacement versus hydraulic pressure curves, or a combination thereof.

10. The work vehicle of claim 9, wherein the controller is configured to receive sensor data from one or more sensors;

wherein estimating the one or more vehicle operation parameters comprises estimating the one or more vehicle operation parameters based on the vehicle data and the sensor data; and wherein the sensor data comprises:

torque associated with an engine of the work vehicle, torque associated with a drive shaft, torque associated with the hydraulic motor, or a combination thereof;

hydraulic pressure associated with the hydraulic pump, hydraulic pressure associated with a hydraulic line coupling the hydraulic pump to the hydraulic motor, hydraulic pressure associated with the hydraulic motor, or a combination thereof;

speed associated with the one or more wheels;

pump displacement associated with the hydraulic pump; or a combination thereof.

11. The work vehicle of claim 1, wherein the vehicle data comprises simulation data associated with one or more operations of the hydraulic pump or the hydraulic motor, and wherein the controller is configured to utilize one or more models to perform one or more simulations to generate the simulation data.

12. The work vehicle of claim 1, wherein the prediction data comprises:

a predicted engine torque at an end of the shift operation; and a predicted hydraulic pressure at the end of the shift operation.

13. The work vehicle of claim 12, wherein the controller is configured to determine that the shift operation is not implementable based at least in part on the predicted engine torque exceeding a threshold engine torque or the predicted hydraulic pressure exceeding a threshold pressure relief setting.

* * * * *